United States Patent [19]

Yie

[11] Patent Number: 4,683,684

[45] Date of Patent: Aug. 4, 1987

[54] HIGH PRESSURE FLUID JET APPARATUS FOR CUTTING AND REMOVING PAVEMENT

[75] Inventor: Gene G. Yie, Auburn, Wash.

[73] Assignee: Electric Power Research Institute, Inc., Palo Alto, Calif.

[21] Appl. No.: 790,052

[22] Filed: Oct. 22, 1985

[51] Int. Cl.[4] ..... B24C 3/06

[52] U.S. Cl. ..... 51/429; 51/410; 299/41; 239/754

[58] Field of Search ..... 51/439, 429, 410, 319–321; 299/17, 41; 404/90; 239/160, 186, 226

[56] References Cited

U.S. PATENT DOCUMENTS

| | | | |
|---|---|---|---|
| 2,018,926 | 10/1935 | Schroepfer | 299/17 |
| 3,432,969 | 3/1969 | Byttebier | 51/429 |
| 3,614,163 | 10/1971 | Anderson | 299/17 |

FOREIGN PATENT DOCUMENTS

| | | | |
|---|---|---|---|
| 0897148 | 11/1953 | Fed. Rep. of Germany | 51/429 |
| 0140776 | 6/1963 | U.S.S.R. | 299/17 |

*Primary Examiner*—Frederick R. Schmidt
*Assistant Examiner*—Robert A. Rose
*Attorney, Agent, or Firm*—James P. Hillman

[57] ABSTRACT

A highly maneuverable mobile abrasive entrained high pressure fluid jet apparatus having a mobile framework for moving one or multiple abrasive entrained high pressure fluid jet nozzles in both the horizonal and transverse directions and a swivel connection for rotating the one or multiple fluid jet nozzles to provide for scarifying large sections of pavement, removing large sections of pavement, or cutting a large circular perimeter of pavement to provide for removing manhole type portions of pavement.

1 Claim, 6 Drawing Figures

HIGH PRESSURE FLUID JET APPARATUS FOR CUTTING AND REMOVING PAVEMENT

BACKGROUND OF THE INVENTION

1. FIELD OF THE INVENTION:

The invention relates in general to abrasive entrained high pressure fluid jet apparatus for cutting and removing pavement and in particular to a highly maneuverable, mobile apparatus having a means for moving one or multiple abrasive entrained high pressure fluid jet nozzles in both the horizontal and transverse directions and a means for rotating the one or multiple fluid jet nozzles to provide for scarifying large sections of pavement, removing large sections of pavement, or cutting a large circular perimeter of pavement to provide for removing manhole type portions of pavement.

2. DESCRIPTION OF THE PRIOR ART:

In populated areas, there are many miles of utility distribution systems. These systems include electrical power and communication cables, water and gas distribution piping systems, sewers, and other special cables, pipes and conduits. Many of these utility systems must be buried underground for aesthetic, protective, and other reasons; they are often buried under streets or other paved areas. Thus, the installation or servicing of utility systems frequently requires excavations to gain access. The first step of such excavations, which are generally in the form of a "manhole" or short trench, is to cut and remove the pavement delineated for excavation. Subsequently, the earth is removed to expose the buried utility systems or to form a trench for installing new systems.

The common tools involved today in manholing, trenching, or patching pavement are saws, handheld jackhammers, backhoes, and trenchers. In case of asphalt pavement, jackhammers or backhoes can be used to break the pavement although the edges of such excavations are very ragged unless saws are used to cut the perimeters. In case of concrete, diamond studded concrete saws are required to first cut the perimeter of a manhole or a trench to a desired depth. Subsequently, jackhammers are used to break the patch or the strip of concrete between two parallel cuts. These conventional approaches of excavation have many drawbacks that contribute to the high cost of such operations. The handheld pneumatic/hydraulic hammers are known to be very slow, noisy, and fatiguing to the operators. These hammers also cannot produce clean edges or avoid the fracture of adjoining concrete, causing the pavement patches to lack permanency. Concrete saws have drawbacks in slow speed of operation, noise generation, need for overcutting at corners, and high cost due to the excessive wear and tear of the saw blade. Finally, the conventional process of removing pavement requires the use of several pieces of equipment and many operators.

Accordingly, it would be desirable to have an abrasive entrained high pressure fluid jet apparatus which is both highly maneuverable and mobil for cutting and removing pavement. Further, it would be desirable if such apparatus had a means for manipulating one or more abrasive entrained high pressure fluid jet nozzles in both the horizontal and transverse directions so as to be able to cut a path of any design for the removal of pavement. A means for rotating such multiple high pressure fluid jet abrasive entrained nozzles would be desirable to provide for scarifying large areas of pavement, cutting a circular perimeter around a predetermined portion of pavement, (such as for the removal of a manhole of pavement) and cutting large diameter holes in pavement.

SUMMARY OF THE INVENTION

Briefly, the present invention is an abrasive entrained high pressure fluid jet apparatus for cutting pavement including a highly maneuverable and mobile frame or chasis with or without its own means for locomotion having mounted thereon a transverse slidable support means for moving one or multiple high pressure fluid jet abrasive entrained nozzles in a transverse direction, the frame or chasis being movable in a horizontal direction. The apparatus for cutting pavement of the invention also includes a swivel means for rotating one or more high pressure fluid jet abrasive entrained nozzles about a predetermined axis to provide for cutting predetermined circular perimeters or manholes in pavement, scarifying large circular areas of pavement and cutting large diameter circular holes in pavement.

BRIEF DESCRIPTION OF THE DRAWINGS

The invention may be understood and further advantages and uses thereof more readily apparent, when considered in view of the following detailed description of exemplary embodiments taken with the accompanying drawings, in which.

DETAILED DESCRIPTION OF THE PREFERRED EMBODIMENTS

Figure 1:
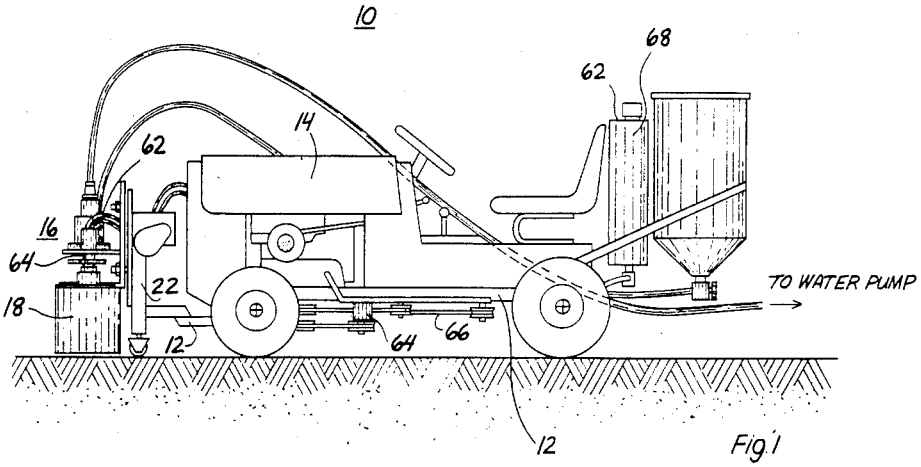
FIG. 1 is a side elevational view of a small mobile tractor chassis having mounted thereon abrasive entrained high pressure fluid jet apparatus for cutting and removing pavement constructed according to the teachings of the invention.
Figure 2:
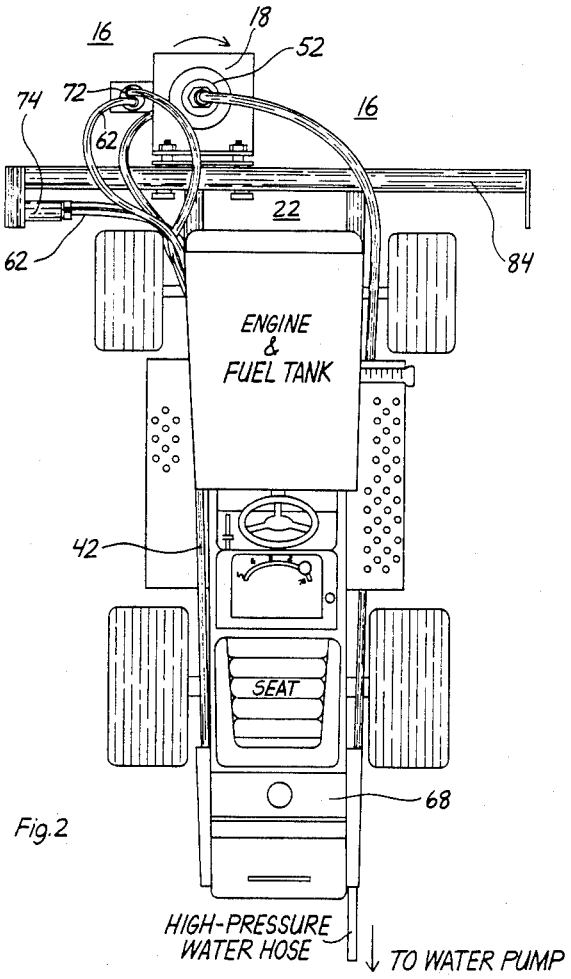
FIG. 2 is a top view of the mobil tractor and high pressure fluid jet abrasive entrained nozzle of FIG. 1.
Figure 3:
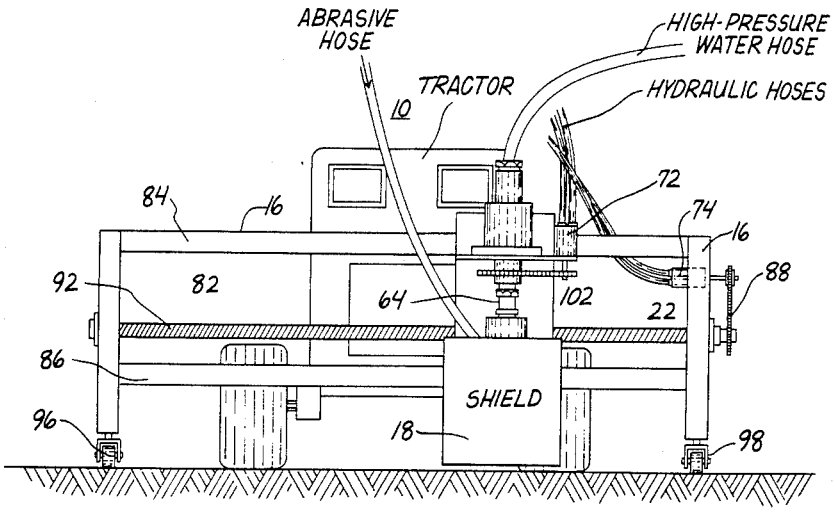
FIG 3 is a front view of the tractor and abrasive entrained high pressure fluid jet nozzle apparatus of FIG. 1.

Referring now to the drawings and to FIGS. 1,2 and 3 in particular there are shown elevational side, top and front views respectively of an abrasive entrained high pressure fluid jet saw for cutting pavement, rock and other high strength materials according to the teachings of the invention. Abrasive entrained high pressure fluid jet saw 10 includes a maneuverable mobile framework or carriage 12 (the embodiment illustrated in FIGS. 1, 2 and 3 being adapted for connection to a small tractor type mobile framework 14) and an abrasive entrained high pressure fluid jet cutting apparatus 16. Mobile framework 14 may be powered by a small internal combustion engine or electrical motor. Mobile carriage 14 should have a wide range of forward speeds from a few inches per minute to a few miles per hour, the slow speeds for applying abrasive waterjet cutting apparatus 16 according to the teaching of the invention and the faster speeds for manipulating the vehicle in the field. Abrasive entrained high pressure fluid jet cutting apparatus 16 includes nozzle shield 18, and traversing means 22 for movement of nozzle shield 18 in the transverse direction (mobile carriage 14 moving the entire vehicle 12 in the horizontal direction).

Figure 4:
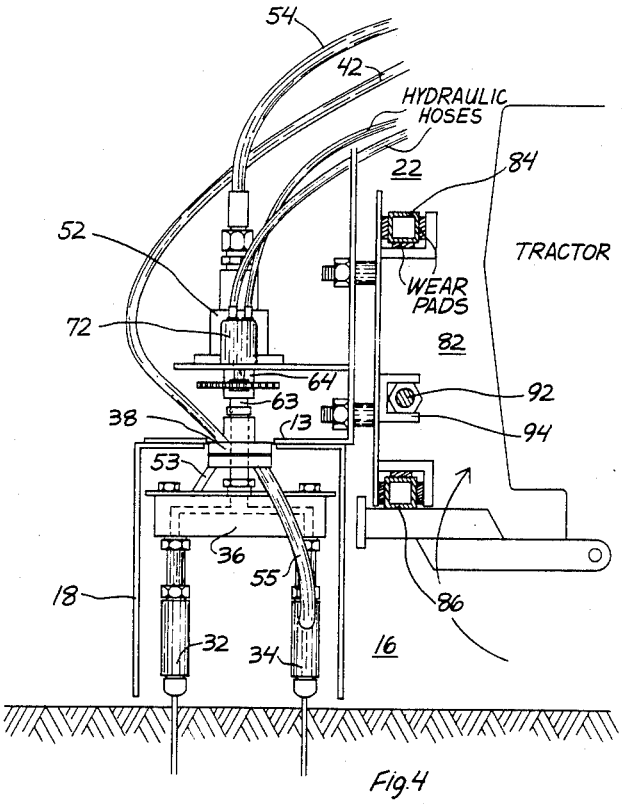
FIG 4 is a detailed side view of the abrasive entrained high pressure fluid jet abrasive entrained nozzle apparatus for cutting and removing pavement mounted on the front of the mobile tractor chassis of FIGS. 1–3 illustrating details of the transverse sliding means for transverse movement of, and the swivel means for rotation of one or multiple abrasive entrained high pressure fluid jet nozzles.

Referring now to FIG. 4, there is shown a detailed side view of an abrasive entrained high pressure fluid cutting apparatus 16, including nozzles 32 and 34 in fluid communication with nozzle manifold 36, a fluid feed tube 63 in fluid communication at one end with nozzle manifold 36 and in fluid communication at the other end with the swivel part 64 of a high pressure fluid swivel means 52, a high pressure fluid hose 54 in fluid communication with the stationary part of said high pressure fluid swivel means 52, an abrasive swivel means 38 having a central passage for routing said fluid feed tube 63 and having an upper stationary part in fluid communication with an abrasive supply hose 42 and a lower swivel part in communication with lower abrasive hose 53 and 55 in fluid communication with nozzle 32 and 34 respectively, a hydraulic motor in chain-and-sprocket connection with said swivel part 64 of said high pressure fluid swivel means 52, a support structure 17 having an upper platform 15 for mounting said high pressure fluid swivel means 52 and said hydraulic motor 72 and a lower platform 13 for mounting nozzle shield 18 and said stationary part of abrasive swivel means 38. In rotating mode opertions, high pressure fluid is supplied to said fluid swivel means 52 through hose 54. The lower swivel part 64 of said fluid swivel 52 is rotated by the hydraulic motor 72 which in turn is powered with pressurized hydraulic fluid through two hydraulic hoses. The rotation of swivel 64 is transmitted to said nozzle manifold 36 and nozzles 32 and 34 through the feed tube 63.

Referring now to FIGS. 1, 2, 3, and 4, there is shown that abrasive entrained high pressure fluid jet cutting apparatus 16 further includes built in hydraulic system 62 to provide power to both transvering means hydraulic motor 74 and rotating means hydraulic motor 72 for rotating and nozzles 32, 34, and nozzle manifold 36, abrasive swivel means 38 and a portion of fluid means 52. Hydraulic system 62 includes hydraulic pump 64, pulley and belt arrangement 66, hydraulic reservoir 68, and hydraulic motors 72 and 74, respectively.

Figure 6:
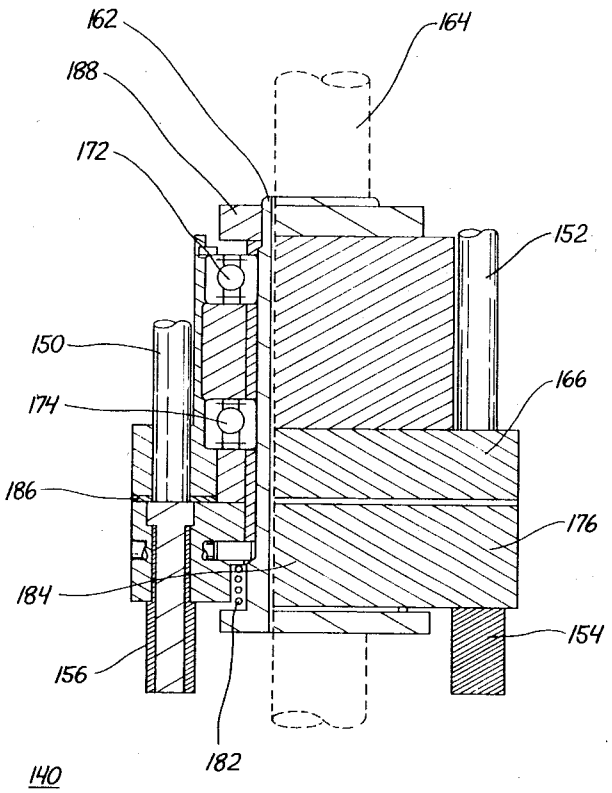
FIG. 6 is an enlarged cross sectional view of the abrasive swivel means constructed according to the teachings of the invention.

Referring now to FIGS. 3, 4, and 6, traversing means 22 includes carriage system 82 having upper and lower sliding bars 84 and 86 respectively, drive train 88, drive screw 92, and drive nut 94, all for movement of abrasive nozzles 32 and 34 in the transverse direction. Support casters 96 and 98 providing for movement of traversing means 22 in the horizontal direction. Hydraulic motor 72, drive line 102, fluid swivel means 52, and abrasive swivel means 38, providing for the rotating of nozzles 32, and 34.

Figure 5:
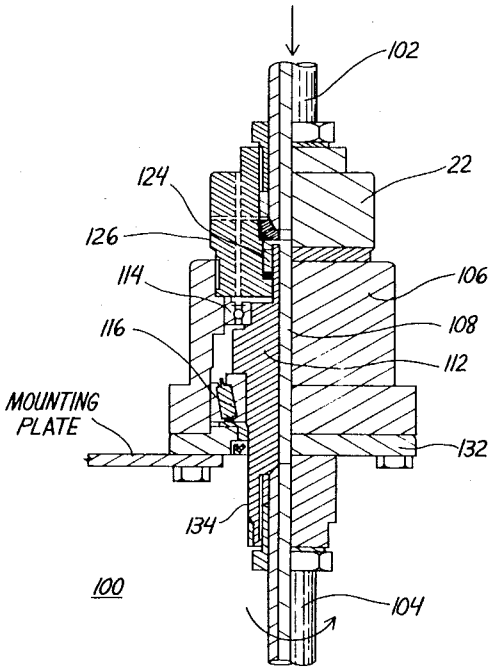
FIG. 5 is an enlarged cross sectional view of the fluid swivel means constructed according to the teachings of the invention.

Referring now to FIGS. 5 and 6 there are shown exploded views of fluid swivel means 52 and abrasive swivel means 38, respectively.

Referring to FIG. 5, is shown a side view of a fluid swivel means 100 which is basically a device that allows pressurized water to be transported from a stationary tube 102 to a rotating tube 104. The swivel means 100 consists of a stationary swivel body 106, having a central cavity 108 for housing a spindle 112 that is held in place by an upper roller bearing 114 and a lower thrust bearing 116, an upper end plug 122 having seal assembly 124 in contact with the spindle 112 on one end and tube gland 126 on other end in communication with said stationary inlet high-pressure tube 102, an end plate 132 for keeping bearing 116 in place and for mounting the said fluid swivel means 100 on a mounting plate, and tube fitting 134 on one end of said spindle 112 for connecting to outlet high pressure tube 104. Because of the seal assembly 124 around the upper end of the spindle 112 and the bearing 112, 114, high-pressure fluid can pass through the central passage of the spindle 112 from the stationary inlet tube 102 to the rotating outlet tube 104 without leakage. A suitable driving means (not shown) can be installed on the outlet tube or on the lower portion of the spindle to impart the desired rotation.

Referring to FIG. 6, there is shown a side sectionalized view of an abrasive swivel 140, which allows abrasives to be transported, in conjunction with high pressure fluid, from two stationary tubes 150, 152 to two rotating tubes 154, 156 respectively. This swivel 150 consists of a clamp sleeve 162 which can be installed tightly around a high pressure fluid tube 164, a stationary upper disk 166 in communication axially with the clamp sleeve 162 through two roller bearings 172 and 174, a rotating lower disk 176 in communication axially with the clamp sleeve 162 through a compression spring 182 and a dowell pin 184 and in communication with the upper stationary disk 166 through a seal disk 186, two stationary abrasive tubes 150, 152, mounted on the stationary disk 166, two rotating abrasive tubes 154, 156 mounted on the lower rotating disk 176, a clamp ring 188 holds clamp sleeve 162 tightly around the high pressure feed tube 164 and holds the two disks 166, 176 against the seal disk 186. In rotating operations, the high pressure feed tube 164 is connected at its upper end to a high pressure fluid swivel (not shown) and is rotating at a desired speed, and is connected at its lower end to a nozzle manifold (not shown) and one or more abrasive fluid jet nozzles (not shown). Thus, high pressure water is transported inside the feed tube to the nozzles. Selected abrasives are fed to the abrasive swivel 140 through two hoses (not shown) and to the two stationary feed tubes 150, 152 and are exiting the abrasive swivel through the two rotating tubes 154, 156 toward the nozzle (not shown). The seal disk 186 allows the two disks 166, 176 to rotate against each other without leakage as the abrasives are propelled from a reservoir (not shown) to the nozzles (not shown) by means of suction generated at the nozzle.

In operation, mobile tractor 14 provides movement of the multiple nozzle system arrangement, such as for instance nozzles 32 and 34 in the horizontal direction, carriage system 82 provides movement of the nozzle system in the transverse direction and the abrasive swivel means 38 and fluid swivel means 52, provide for rotating nozzles 32 and 34. The fluid communications system between the abrasive hose 42 and the high pressure fluid hose 54, with the nozzle systems such as nozzles 32 and 34 respectively, provides for cutting concrete or other hard materials in any desired perimeter shape, as well as scarifying or cutting manhole-type, circular shape excavations. Carriage system 82 mobile tractor 14 abrasive swivel means 38 and fluid swivel means 52 then combine to provide a movable chassis which can be used for manipulating one or multiple high pressure abrasive entrained fluid jet nozzles for various methods and processes for cutting and removing pavement with abrasive water jets by cutting desired perimeters around the pavement to be removed or broken up. For example one method might be to position on high pressure abrasive entrained fluid jet nozzle on this movable chassis, proximate the pavement or other material to be cut, applying high pressure abrasive entrained fluid jet through the fluid jet nozzle and moving the mobile chassis in the horizonal transverse and circular directions so as to move the high pressure abrasive entrained fluid jet nozzle in the horizonal transverse circular directions to cut a perimeter of any desired shape around the circumference of the pavement desired to be removed. Alternate methods might be to move the movable chassis in decreasing lengths and radiuses from the lenghts and radius which cut the outside perimeter so as to cut multiple smaller permiters within the outside perimeter so as to provide multiple cuts across the entire surface of the pavement desired to be removed. Another method this apparatus is capable of performing would be to mount multiple high pressure abrasive entrained fluid jet nozzles on the movable chassis at predetermined distances from a predetermined axis as described above and by rotating the multiple high pressure fluid jet nozzle as describe herein while moving movable chassis in the horizonal and/or transverse directions would scarify the entire surface to a predetermined depth.

I claim:

1. High pressure fluid apparatus for cutting pavement and other high strength materials comprising:

(a) a mobile framework adapted for movement in a horizontal direction;

(b) a mobile carriage and carriage means for moving said mobile carriage in a direction transverse to said horizontal direction, said carriage means being disposed in said mobile framework;

(c) fluid swivel means mounted on said carriage having first and second portions, means for providing rotation of said first portion of said fluid swivel means relative to said second portion of said fluid swivel means without interruption of a high pressure fluid flow, said fluid swivel means being adapted for fluid communication with a source of high pressure fluid;

(d) an abrasive swivel means mounted on said carriage having first and second portions for providing a noninterrupted flow of abrasive materials, said first portion being rotatable relative to said second portion of said abrasive swivel means; said abrasive swivel means being adapted for connection to a source of abrasive material.

* * * * *